US005456155A

United States Patent [19]

Myrtoglou

[11] Patent Number: 5,456,155

[45] Date of Patent: Oct. 10, 1995

[54] BULLET TRAP ASSEMBLY

[76] Inventor: Magdi M. Myrtoglou, P.O. Box 541581, Houston, Tex. 77254

[21] Appl. No.: 209,441

[22] Filed: Mar. 10, 1994

[51] Int. Cl.[6] ..... F41H 5/06; F41J 1/12

[52] U.S. Cl. ..... 89/36.02; 273/410

[58] Field of Search ..... 89/36.02; 273/410, 273/404

[56] References Cited

U.S. PATENT DOCUMENTS

| | | | |
|---|---|---|---|
| 385,546 | 7/1888 | Decumbus | 273/404 |
| 2,013,133 | 9/1935 | Caswell | 273/410 |
| 2,201,527 | 5/1940 | Freeman | 273/404 |
| 2,420,304 | 5/1947 | Diem | 273/410 |
| 3,447,806 | 6/1969 | Pfaff et al. | 89/36.02 |
| 3,701,532 | 10/1972 | Nikoden | 273/410 |
| 3,737,165 | 6/1973 | Pencyla | 273/410 |
| 4,512,585 | 4/1985 | Bavavaglio | 273/410 |
| 5,121,671 | 6/1992 | Coburn | 89/36.02 |
| 5,259,291 | 11/1993 | Wilson | 89/36.02 |

*Primary Examiner*—Charles T. Jordan
*Attorney, Agent, or Firm*—John R. Casperson

[57] ABSTRACT

There is a disclosed method and apparatus for trapping bullets in an indoor range having a first end and a second end by use of a bullet trap. The bullet trap is formed from an upper plate and a lower plate and a liquid-filled trough. The bullet trap is positioned near the second end of the indoor range. The upper plate and said lower plate converge together toward the second end of the indoor range to form a horizontally positioned slot between an upper end of the lower plate and a portion of the upper plate. The upper plate preferably curves downwardly between the slot and the second end of the range and ends in a generally vertically downward orientation pointed toward the liquid filled trough. Bullets fired into the bullet trap from the first end of the range pass through the slot and are trapped in the liquid filled trough. The method keeps airborne lead concentrations at low levels.

13 Claims, 2 Drawing Sheets

BULLET TRAP ASSEMBLY

BACKGROUND OF THE INVENTION

This invention relates to an improved bullet trap.

Most bullet traps expend the energy of the bullet in a manner that causes vaporization of the lead. This leads to potentially hazardous airborne concentrations of lead, particularly indoors. A bullet trap which expends the energy of the bullet in a liquid medium would be very desirable, since it offers the potential for maintaining airborne lead at low levels.

Existing designs for bullet traps are complicated and sometimes present a ricochet hazard. For a commercial facility, a large aiming area and a low likelihood of ricochets is vital. A bullet trap which offers a large aiming area, low possibility of ricochets, and is simple in construction would be very desirable.

Many traps are serf contained and have to be installed one trap per firing point. A trap which offers modular construction would be very desirable.

OBJECTS OF THE INVENTION

It is an object of this invention to stop bullets in a manner which does not result in the generation of high levels of airborne lead.

It is a further object of this invention to provide a bullet trap which captures the energy of the bullet in a liquid medium.

It is another object of this invention to provide a bullet trap which has a large aiming area, low possibility of ricochets, and is simple in construction.

It is a further object of this invention to provide a bullet trap which offers modular design.

SUMMARY OF THE INVENTION

In accordance with one embodiment of the invention, there is provided a bullet trap assembly comprising an upper plate and a lower plate. The upper plate has a front side, a back side, an upper end, a lower end, and a downwardly curved portion which terminates at the lower end of the plate. The lower plate has a front side, a back side, a lower end and an upper end. The lower plate is positioned beneath the upper plate so that the upper end of the lower plate is positioned closer to the upper plate than the lower end of the lower plate. A slot is formed between the upper end of the lower plate and the front side of the upper plate. The combination of the upper plate and the lower plate together form a bullet trap assembly having a first end and a second end. The downwardly curved portion of the upper plate forms the second end of the bullet trap assembly.

In a preferred embodiment of the invention, the slot is horizontally oriented and a trough is positioned beneath the lower end of the upper plate. When the trough is filled with a liquid, bullets fired through the slot are trapped in the liquid in a manner which keeps airborne lead at low levels.

In another embodiment of the invention, there is provided a bullet trap assembly comprising an upper plate, a lower plate, and a trough. The upper plate has a front side, a back side, an upper end, and a lower end. The lower plate has a front side, a back side, a lower end and an upper end. The lower plate is positioned beneath the upper plate so that the upper end of the lower plate is positioned closer to the upper plate than the lower end of the lower plate. A slot is formed between the upper end of the lower plate and the front side of the upper plate. A trough is positioned with respect to the lower end of the upper plate so that bullets deflected by the upper plate enter the trough. The upper plate and the lower plate together forming a bullet trap assembly having a first end and a second end, the trough being positioned at the second end of the bullet trap assembly.

In another embodiment of the invention, there is provided a method for trapping bullets in an indoor range having a first end and a second end by use of a bullet trap. The bullet trap is formed from an upper plate and a lower plate and a liquid-filled trough. The bullet trap is positioned near the second end of the indoor range. The upper plate and the lower plate converge together toward the second end of the indoor range to form a horizontally positioned slot between an upper end of the lower plate and a portion of the upper plate. The upper plate curves downwardly between the slot and the second end of the range and ends in a generally vertically downward orientation pointed toward the liquid filled trough. Bullets fired into the bullet trap from the first end of the range pass through the slot or are guided by the upper and/or lower plates and pass through the slot and expend all of their remaining energy in the liquid filled trough. The method keeps airborne lead concentrations at low levels.

DETAILED DESCRIPTION OF THE PREFERRED EMBODIMENTS

Figure 1:
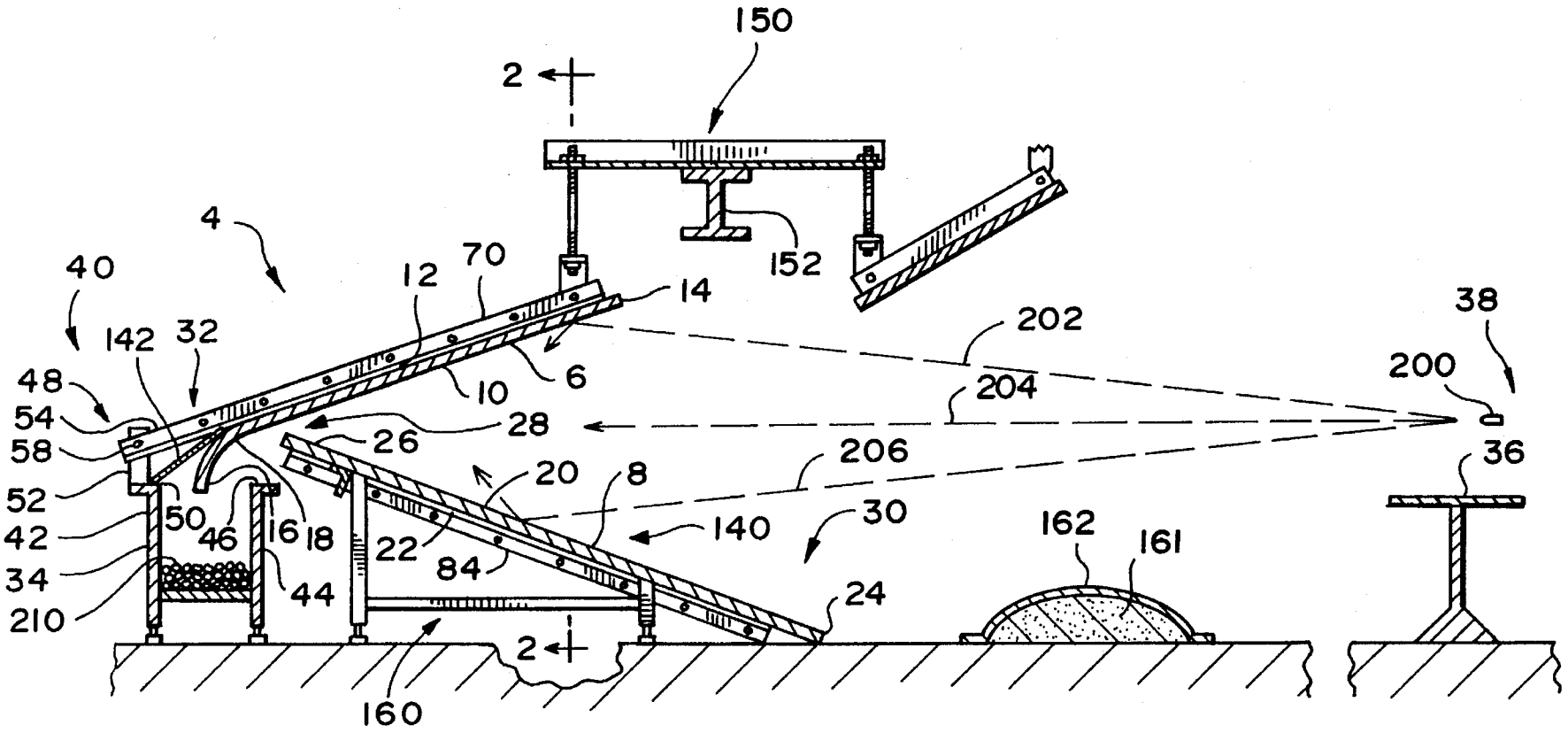
FIG. 1 is a cross sectional view of a bullet trap assembly constructed according to certain embodiments of the invention.

In accordance with one embodiment of the invention, there is provided a bullet trap assembly 4 comprising an upper plate 6 and a lower plate 8. The upper plate 6 has a front side 10, a back side 12, an upper end 14, a lower end 16. Preferably, the upper plate 6 has a downwardly curved portion 18 which terminates at the lower end 16 of the plate 6. The lower plate 8 has a front side 20, a back side 22, a lower end 24 and an upper end 26. The lower plate 8 is positioned beneath the upper plate 6 so that the upper end 26 of the lower plate 8 is positioned closer to the upper plate 6 than the lower end 24 of the lower plate 8. A slot 28 is formed between the upper end 26 of the lower plate 8 and the front side 10 of the upper plate 6. The combination of the upper plate and the lower plate together form a bullet trap assembly 4 having a first end 30 and a second end 32. The downwardly curved portion 18 of the upper plate 6 forms the second end 32 of the bullet trap assembly in this embodiment of the invention.

In a preferred embodiment of the invention, the bullet trap assembly 4 further comprises a trough 34 positioned with respect to the lower end 16 of the upper plate 6 so that bullets deflected by the upper plate 6 enter the trough 34. Preferably, the trough 34 is positioned beneath the lower end 16 of the upper plate 6. In this embodiment, the trough forms the second end 32 of the bullet trap assembly 4. It is further preferred that the slot 28 be generally horizontally oriented.

Figure 2:
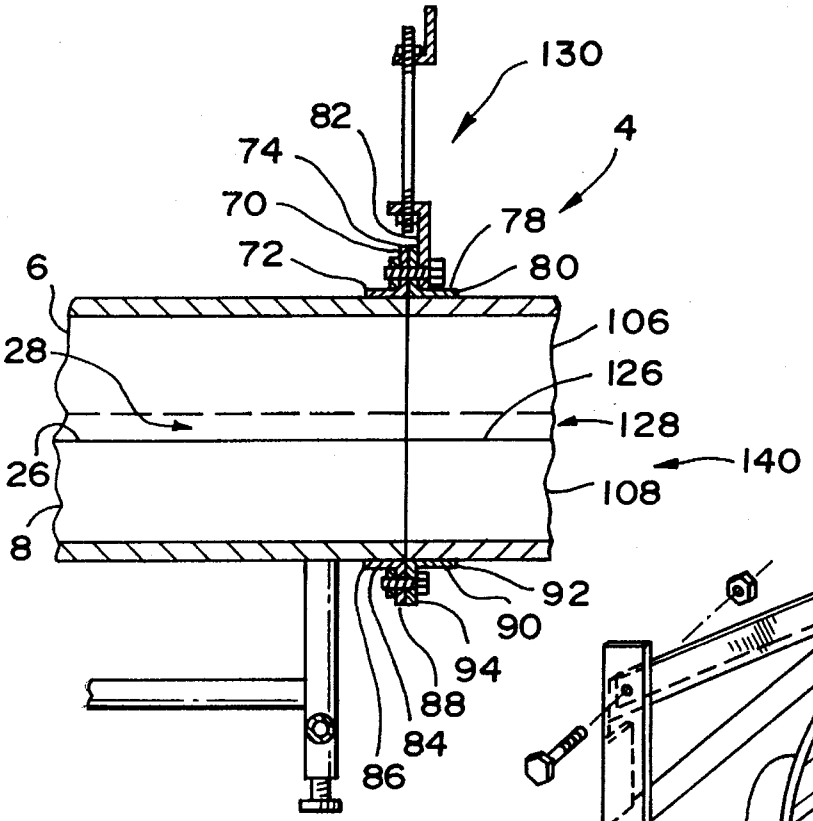
FIG. 2 is a cross sectional view of the bullet trap assembly of FIG. 1 as would be seen when viewed along lines 2—2.

This aspect of the invention is best shown in FIG. 2. It is further preferred that the downwardly curved portion 18 of the upper plate 6 extends in the direction of the trough 34. In this manner, bullets fired from firing position 36 located at the first end 38 of the range will pass through the slot 28 of the bullet trap assembly 4 positioned adjacent the second end 40 of the range and be trapped in trough 34.

For range integrity, it is preferred that the upper end 26 of the lower plate 8 be higher than the lower end 16 of the downwardly curved portion 18 of the upper plate 6. This geometry assures that all bullets fired into the trap assembly will impact the trap. To reduce splashing onto the front side of the plates, the slot 28 should be narrow. Generally, the slot 28 has a width as measured vertically in the range of from about 1 cm to about 10 cm, usually in the range of from about 2 cm to about 7 cm.. When employed, the downwardly curved portion of the upper plate generally has a radius of curvature in the range of from about 20 inches (50.8 cm.) to about 40 inches (101.6 cm).

When present, the trough 34 has a back side 42 which defines the second end 32 of the bullet trap assembly 4 and an opposite, parallel front side 44 facing the first end 30 of the bullet trap assembly. The front side 44 of the trough has an upper edge 46 which is positioned at a height which is less than the height of the upper end 26 of the lower plate 8. This prevents destruction of the trough and the possibility of ricochets off of the front side of the trough. Preferably, bullet trap assembly 4 further comprises a mounting means 48 extending from an upper edge 50 of the back side 42 of the trough 34 to the back side 12 of the upper plate 6 to mount the upper plate 6 with respect to the trough 34. The mounting means 48 can comprise a first support member 52 extending upwardly from the back side 42 of the trough 34 and a second support member 54 extending downwardly from the back side 12 of the upper plate 6. A hinge pin 58 pivotally connects the first support member 52 to the second support member 54 to provide a means for adjusting the angle of the upper plate.

In a preferred embodiment, the trap assembly 4 is modular, and can be made to accommodate as many firing points as space permits simply by adding modules. The construction of one such additional module is as follows. A second upper plate 106 has a front side, a back side, an upper end, a lower end, and a downwardly curved portion which terminates at the lower end. The second upper plate 106 is positioned alongside the upper plate 6 in edge to edge relationship with the upper plate 6. A second lower plate 108 having a front side, a back side, a lower end and an upper end 126 is positioned beneath the second upper plate 106 so that the upper end 126 of the second lower plate 108 is positioned closer to the second upper plate 106 than the lower end of the second lower plate 108. A slot 128 is formed between the upper end 126 of the second lower plate 108 and the front side of the second upper plate 106. The second lower plate 108 is positioned alongside the lower plate 8 in edge to edge relationship with the lower plate 108 so that the slot 128 formed between the second upper plate 106 and the second lower plate 108 forms a continuation of the slot 28 formed between the upper plate 6 and the lower plate 8. The trough 34 extends beneath the lower end of the second upper plate 106.

In a preferred embodiment of the invention, the modules are bolted together. This can be done using angle irons. A first angle brace 70 formed from a first strip 72 and a second strip 74 is mounted by the first strip 72 to the back side of the upper plate 6 along the side edge adjacent to the second upper plate 106 such as by welds 71. A second angle brace 78 formed from a first strip 80 and a second strip 82 is mounted by the first strip 80 on the back side of the second upper plate 106 along the side edge adjacent to the upper plate 6. The second strip 74 of the first angle brace 70 is fastened to the second strip 82 of the second angle brace 78 to urge the side edge of the upper plate 6 closely against the side edge of the second upper plate 106 and form an upper plate assembly 130. A third angle brace 84 is formed from a first strip 86 and a second strip 88 is mounted by the first strip 86 to the back side of the lower plate 8 along the side edge adjacent to the second lower plate 108. A fourth angle brace 90 formed from a first strip 92 and a second strip 94 is mounted by the first strip 92 to the back side of the second lower plate 108 along the side edge adjacent to the lower plate 8. The second strip 88 of the third angle brace 84 is fastened to the second strip 94 of the fourth angle brace 90 to urge the side edge of the lower plate 8 closely against the side edge of the second lower plate 108 and form a lower plate assembly 140.

Figure 3:
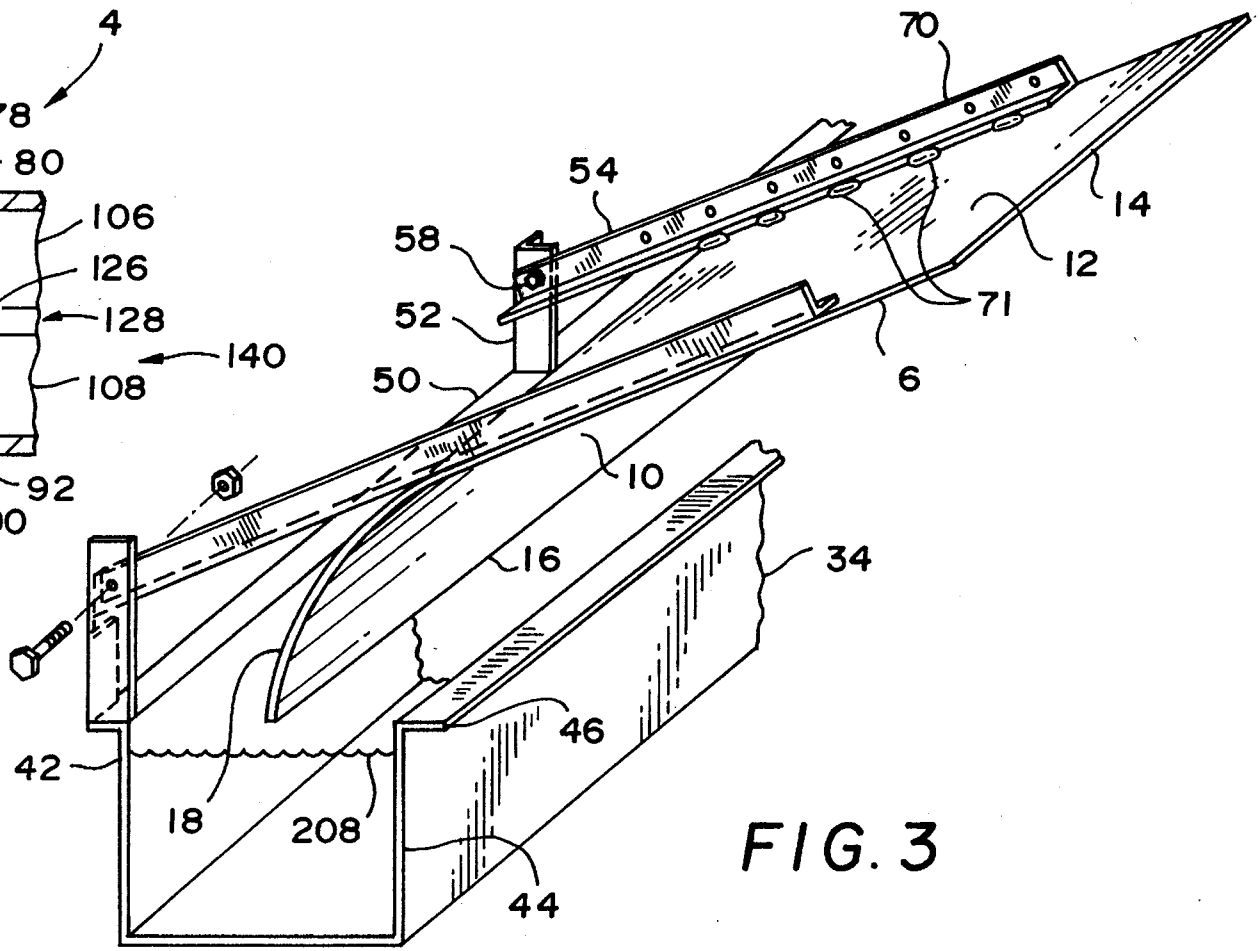
FIG. 3 is an isometric view of a portion of the apparatus in FIGS. 1 and 2 from one end of the trough with the trough end plate removed to show construction details.

In use, the trough will be filled with a liquid, generally water as indicated by level 208 in FIG. 3. Bullets entering the liquid loose their energy and are retained. Divided materials 210 such as spent bullets positioned in the bottom of the trough will protect the bottom of the trough and assist in safely expending the energy of the entering bullets. To help keep water and assist in retaining bullet particles in the trough, it is desirable to position a cover 142 on the trough. The cover 142 can rest in covering relationship with the upper edge 50 of the back side of the trough 34 and the back side 12 of the upper plate 6.

The bullet trap assembly can be positioned structurally independent of the building structure in which the range is housed. In the illustrated embodiment, a means 150 for suspending the upper plate assembly 130 apart from the lower plate assembly is provided including an I beam 152. The I beam 152 can be mounted to post beams not shown. A means 160 supports the lower plate assembly 140 off of the floor. It is expected that good results can be obtained by hinging the upper end of the lower plate to the upper end of the front side of the trough. Preferably, both the means 150 and the means 160 are adjustable so that the angle between the plates and the dimensions of the slot can be regulated as the modules are installed.

Generally speaking, the suspending means and the supporting means are adjusted so that the angle between the plate assemblies is in the range of about 15 degrees to about 90 degrees. Usually, the angle will be in the range of about 20 degrees to about 45 degrees. Preferably, each plate is oriented at about the same angle from the horizontal, generally in the range of from about 10 degrees to about 20 degrees. Jack screws can also be positioned on the legs supporting the trough to enable the trough to be leveled during fabrication.

To prevent ricochets and damage to the lower end 24 of the lower plate 8, a sand pile 161 is preferably positioned on the floor at a spaced apart distance from the lower end 24 of the lower plate 8. A fabric cover 162 is preferably positioned on the sand pile 161 to reduce the amount of sand thrown up on the plates.

In another embodiment of the invention, there is provided a method for trapping bullets in an indoor range having a first end and a second end by use of a bullet trap. The bullet trap can be as described above. The bullet trap is positioned near the second end of the indoor range. The trough is filled with liquid, generally water. A bullet 200 fired into the bullet trap from the first end of the range will pass through the slot 28 and be trapped in the liquid filled trough. The method keeps airborne lead concentrations at low levels. The plates are angled so that the bullet 200 can take a high path 202, a middle path 204, or a low path 206 and still pass through the slot, being deflected by the plates if necessary.

Airborne lead levels can be further reduced by applying a lubricant such as a layer of grease to the upper and lower plates and by using jacketed or plated bullets. Using plates which are angled in small amounts from the horizontal, such as 15 degrees from the horizontal, will also help prevent bullet deformation and lead vaporization on bullet impact. Positioning the trap so that a majority of the bullet impacts occur on the upper plate near the slot will also reduce lead levels since bullets which strike the lower plate will have impacts against both the lower and upper plates prior to becoming trapped. Preferably, the major impact area is on the upper plate just forward of the slot. Making the slot smaller will also assist is segregating the trapped projectiles from the shooters area.

To maximize range life, it is also important that the angle of inclination of the plates from the horizontal be small. Also, where the trap has been assembled in modules, the firing points should be aligned between the joints between the plates so that only a minority of bullet impacts occur on the joints. A sand pile can be positioned on the floor in front of the lower plate to prevent the edge of the plate from becoming impact damaged. To prevent sand from being thrown up and contaminating the lubricant, the sand pile should be spaced apart from the edge of the plate, and preferably covered with a fabric material.

During firing times, it is important to maintain air flow from the firing position generally toward the second end of the range. Preferably, air flow is directed outwardly and upwardly from the shooter to an exhaust duct a short distance from the firing line. Additional exhaust ducts can be positioned between the first duct and the bullet trap assembly and activated as required to clear out smoke.

EXAMPLE

A ten point indoor range was constructed using the design generally shown by the figures. The plates were constructed from SA 515 - 70 pressure plate grade steel ⅜ inch thick. The upper plates had a width of 8 feet and a straight section length of 10 feet and had a lower curved section two feet in length with a 30 inch radius. The lower plates measured 8 feet by 12 feet. The plates were inclined 15 degrees from the horizontal and led to a slot 1.5 inches in height. The plates were bolted together using 3 inch angle iron welded to the backsides of the plates ⅛ inch from the edge. The joints between the plates were filled with a synthetic adhesive filler prior to being bolted together. The joints between the plates were aligned between the shooting points. The plates were adjustably suspended to the support structure using threaded rods and supported on a 6 foot square support structure. The trough was fabricated on site from ¼ inch steel and had a depth and width of 24 inches although a deeper trough would be desirable for centerfire rifle bullets. The plates were greased every few weeks. The trap was rated by a ballistics expert at 2,000 ft-lbs, 2,000 fps at 90 degree impact.

This structure was used in a commercial shooting facility beginning about 18 months prior to the filing of this patent application. During that time, it is estimated that about 6 million rounds of pistol and shotgun ammunition was expended into it. Usual maximum intensity was about 500 ft-lbs, 1300 fps, jacketed ammunition. After several months of such operations, inspection of the range revealed that airborne lead levels had increased only fractionally over new conditions, that the plates had suffered no visually apparent bullet impact damage, and that rust in the trough area was within acceptable levels. One modification made to the trap area during the period of use was installing covers 142 to keep water and bullet fragments from splashing out of the trough. Nearly all of the bullets recovered from the trap are intact. Life of the trap is estimated at 15 years.

What is claimed is

1. A bullet trap assembly comprising: an upper plate having a front side, a back side, an upper end, and a lower end, the upper plate having a downwardly curved portion which terminates at the lower end of the upper plate;

a lower plate having a front side, a back side, a lower end and an upper end, said lower plate being positioned beneath the upper plate so that the upper end of the lower plate is positioned closer to the upper plate than the lower end of the lower plate so that a generally horizontal slot is formed between the upper end of the lower plate and the front side of the upper plate; and a trough positioned with respect to the lower end of the upper plate so that bullets deflected by the upper plate enter the trough;

the upper plate and the lower plate together forming a bullet trap assembly having a first end and a second end with the trough forming the second end of the bullet trap assembly.

2. A bullet trap assembly comprising an upper plate having a front side, a back side, an upper end, and a lower end; and a lower plate having a front side, a back side, a lower end and an upper end, said lower plate being positioned beneath the upper plate so that the upper end of the lower plate is positioned closer to the upper plate than the lower end of the lower plate so that a generally horizontal slot is formed between the upper end of the lower plate and the front side of the upper plate: and a trough positioned with respect to the lower end of the upper plate so that bullets deflected by the upper plate enter the trough;

wherein a downwardly curved portion of the upper plate extends in the direction of the trough, and the trough contains a liquid: the upper plate and the lower plate together forming a bullet trap assembly having a first end and a second end with the trough forming the second end of the bullet trap assembly.

3. bullet trap assembly as in claim 2 wherein the upper end of the lower plate is higher than the lower end of the downwardly curved portion of the upper plate, and the slot has a width as measured vertically in the range of from about 1 cm to about 10 cm.

4. A bullet trap assembly as in claim 3 wherein the trough has a back side which defines the second end of the bullet trap assembly and an opposite, parallel front side facing the first end of the bullet trap assembly, the front side of the trough having an upper edge which is positioned at a height which is less than the height of the upper end of the lower plate, said bullet trap assembly further comprising a mounting arm extending from an upper edge of the back side of the trough to the back side of the upper plate to position the upper plate with respect to the trough.

5. A bullet trap assembly as in claim 1 further comprising a second upper plate having a front side, a back side, an upper end, a lower end, and a downwardly curved portion which terminates at the lower end, said second upper plate being positioned alongside the upper plate and in edge to edge relationship therewith;

a second lower plate having a front side, a back side, a lower end and an upper end, said second lower plate being positioned beneath the second upper plate so that the upper end of the second lower plate is positioned closer to the second upper plate than the lower end of the second lower plate so that a slot is formed between the upper end of the second lower plate and the front side of the second upper plate, the second lower plate being positioned alongside the lower plate and in edge to edge relationship therewith so that the slot formed between the second upper plate and the second lower plate forms a continuation of the slot formed between the upper plate and the lower plate;

wherein the trough extends beneath the lower end of the second upper plate.

6. A bullet trap as in claim 5 further comprising a first angle brace formed from a first strip and a second strip mounted by the first strip to the back side of the upper plate along the side edge adjacent to the second upper plate;

a second angle brace formed from a first strip and a second strip mounted by the first strip on the back side of the second upper plate along the side edge adjacent to the upper plate;

wherein the second strip of the first angle brace is fastened to the second strip of the second angle brace to urge the side edge of the upper plate closely against the side edge of the second upper plate and form an upper plate assembly;

a third angle brace formed from a first strip and a second strip mounted by the first strip to the back side of the lower plate along the side edge adjacent to the second lower plate; and a fourth angle brace formed from a first strip and a second strip mounted by the first strip on the back side of the second lower plate along the side edge adjacent to the lower plate;

wherein the second strip of the third angle brace is fastened to the second strip of the fourth angle brace to urge the side edge of the lower plate closely against the side edge of the second lower plate and form a lower plate assembly.

7. A bullet trap assembly in claim 3 further comprising a means for suspending the upper plate assembly apart from the lower plate assembly and a means for supporting the lower plate assembly off of the floor.

8. A bullet trap assembly as in claim 7 wherein the suspending means and the supporting means are adjusted so that the angle between the upper plate assembly and the lower plate assembly is in the range of from about 15 degrees to about 90 degrees.

9. A bullet trap assembly as in claim 8 wherein the angle is in the range of from about 20 degrees to about 45 degrees.

10. A bullet trap assembly as in claim 9 wherein the downwardly curved portion of the upper plate assembly has a radius of curvature in the range of 20 inches (50.8 cm) to about 40 inches (101.6 cm).

11. A bullet trap assembly as in claim 10 wherein the lower end of the upper plate assembly is oriented generally vertically downwardly and each of the upper plate assembly and the lower plate assembly form an angle of between 10 degrees and 20 degrees with the horizontal.

12. A bullet trap assembly as in claim 11 further comprising a sand pile positioned on the floor at a spaced apart distance from the lower end of the lower plate assembly and a fabric cover in covering relationship with said sand pile.

13. A bullet trap assembly comprising an upper plate having a front side, a back side, an upper end, a lower end, and a downwardly curved portion which terminates at the lower end; and a lower plate having a front side, a back side, a lower end and an upper end, said lower plate being positioned beneath the upper plate so that the upper end of the lower plate is positioned closer to the upper plate in the lower end of the lower plate so that a generally horizontal slot is formed between the upper end of the lower plate and the front side of the upper plate, the upper plate and the lower plate together forming a bullet trap assembly having a first end and a second end, wherein the upper plate comes downwardly between the slot and the second end of the bullet trap assembly and ends in a generally vertically downward orientation, wherein the downwardly curved portion of the upper plate forms the second end of the bullet trap assembly.

* * * * *